United States Patent [19]

Hobson et al.

[11] Patent Number: 4,919,335

[45] Date of Patent: Apr. 24, 1990

[54] METHOD AND APPARATUS FOR ATOMIZATION AND SPRAYING OF MOLTEN METALS

[75] Inventors: David O. Hobson; Igor Alexeff, both of Oak Ridge; Vinod K. Sikka, Clinton, all of Tenn.

[73] Assignee: The United States of America as represented by the United States Department of Energy, Washington, D.C.

[21] Appl. No.: 221,393

[22] Filed: Jul. 19, 1988

[51] Int. Cl.[5] ..... B05B 5/06; B05B 7/18

[52] U.S. Cl. ..... 239/3; 239/690; 239/83; 239/545

[58] Field of Search ..... 264/16; 425/3, 6; 75/0.5 C; 239/135, 137, 3, 690, 708, 543, 545

[56] References Cited

U.S. PATENT DOCUMENTS

| | | | |
|---|---|---|---|
| 1,569,564 | 1/1926 | Miller | 239/80 |
| 3,313,608 | 4/1967 | Guger et al. | 264/10 |
| 3,830,603 | 8/1974 | Blucher et al. | 75/0.5 C |
| 4,264,641 | 4/1981 | Mahoney et al. | 75/0.5 C |
| 4,272,463 | 6/1981 | Clark et al. | 264/12 |

FOREIGN PATENT DOCUMENTS

| | | |
|---|---|---|
| 531187 | 10/1956 | Canada . |
| 730881 | 1/1943 | Fed. Rep. of Germany . |

OTHER PUBLICATIONS

E. J. Lavernia and N. J. Grant, "Ultrasonic Gas Atomization," Metal Powder Report 41, 4 (Apr. 1986), 255.

Alan Lawley, "Modern Powder Metallurgy Science and Technology," J. of Metals, Aug. 1986, pp. 15–25.

P. E. Hugo et al., "Characteristics of Tin Powder Produced by an Annular Gas Atomization Nozzle," The International Journal of Powder Metallurgy & Powder Tech., vol. 18, No. 4, 1982.

R. W. Evans, A. G. Leatham, and R. G. Brooks, "The Osprey Preform Process," Powder Metallurgy 28, 1 (1985) 13.

B. A. Rickinson, F. A. Kirk, and D. R. G. Davies, "CSD: A Novel Process for Particle Metallurgy Products," Powder Metallurgy 24, 1 (1988) 1.

E. Lavernia, G. Rai, and N. J. Grant, "Liquid Dynamic Compaction of a Rapidly Solidified High Strength Aluminum Alloy," Int. J. Powder, Met. 22, 1 (1986) 9.

E. Lavernia, N. J. Grant, T. Ando, "Structure and Properties of the Lithium Containing X2020 Aluminum Alloys Produced by Liquid Dynamic Compaction," Proc. Intl. Conf. Rapidly Solidified Materials, San Diego, CA 3–5 Feb. 1986, Amer. Soc. for Metals, Metals Park, OH (1986) 29.

E. Lavernia, Development of the Liquid Dynamic Compaction Technique and its Application to Two High Strength Aluminum Alloys, Ph.D. Thesis, (1986) M.I.T., Cambridge, MA.

K. Ogata, E. Lavernia, G. Rai, and N. J. Grant, "Structure and Properties of a Rapidly Solidified Superalloy Produced by Liquid Dynamic Compaction," Intl. J. Rapid Solidification, 2, 1 (1986) 21.

*Primary Examiner*—Andres Kashnikow
*Assistant Examiner*—Kevin P. Weldon
*Attorney, Agent, or Firm*—Stephen D. Hamel; William R. Moser; Richard E. Constant

[57] ABSTRACT

A method and device for dispersing molten metal into fine particulate spray, the method comprises applying an electric current through the molten metal and simultaneously applying a magnetic field to the molten metal in a plane perpendicular to the electric current, whereby the molten metal is caused to form into droplets at an angle perpendicular to both the electric current and the magnetic field. The device comprises a structure for providing a molten metal, appropriately arranged electrodes for applying an electric current through the molten metal, and a magnet for providing a magnetic field in a plane perpendicular to the electric current.

7 Claims, 7 Drawing Sheets

METHOD AND APPARATUS FOR ATOMIZATION AND SPRAYING OF MOLTEN METALS

The present invention relates to a method for dispersing molted metals into fine particle droplets and, more particularly, to the simultaneous action of an electric current and a magnetic field on a molten metal, which causes the molten metal to break up into droplets. The U.S. Government has rights in this invention pursuant to Contract No. DE-AC05-840R21400, awarded by the U.S. Department of Energy.

BACKGROUND OF THE INVENTION

In recent years, there has been a significant amount of commercial interest in the deposition and buildup of metal sheets and plates which are made from a liquid or semiliquid spray impinging on a cooled substrate. Highly attractive combinations of properties and structures are achievable through rapid solidification of a sprayed stream of molten metal. The current deposition techniques include using a high-pressure inert gas jets to break a falling stream of liquid metal into fine droplets, while at the same time imparting a downward acceleration to those droplets. Several technologies presently exist for spray deposition of metals. These include the conventional process known as the Osprey process, the Controlled Spray Deposition process, and the Liquid Dynamic Compaction (LDC) process. These technologies all use a high pressure gas for atomizing a molten metal.

In addition to the above, thermal spraying is also widely used for the applications of coatings which are resistant to oxidation, corrosion, abrasion, erosion, impact and wear. Thermal spray is a generic term for a group of processes used for depositing metallic coatings. These processes, sometimes known as metalizing, include flame spraying, plasma-arc spraying, and electric-arc spraying. The coatings are generally sprayed from a rod or wire stock or from powdered material. The wire or rod is fed into a flame or plasma, where it is melted. The molten stock is then stripped from the wire or rod and atomized by a high velocity stream of compressed gas which propels the material onto a substrate.

A major problem with the convention methods, such as those discussed above, is that they usually use a high pressure compressed gas for atomizing the molten metal. This gas impingement, used as a means for breaking a molten metal stream into fine particles often requires the use of an inert gas, in order to avoid contamination of the molten metal. Inert gases are often expensive, which increases the cost of the process and the resulting product. Due to the fact that the conventional process requires the use of a high pressure or compressed gas for atomizing the molten metal, such process is limited in that use of high-vacuum melting and casting procedures is not possible therewith. Further, when a high-pressure gas, for example, from jets, is used to create a metal spray, some of the inert gas is entrapped in the impinging droplets of the molten metal.

SUMMARY OF THE INVENTION

Accordingly, it is an object of the present invention to provide an improved method and apparatus for producing a fine-particle, molten metal spray.

Another object of this invention is to provide a method and apparatus for propelling a molten metal particle spray onto a substrate without the use of a high pressure or compressed gas.

A further object of this invention is to provide a method and apparatus for atomizing molten metals in a vacuum.

Upon further study of the specification and appended claims, further objects and advantages of the present invention will become apparent to those skilled in the art.

DETAILED DESCRIPTION

The present invention uses magnetohydrodynamic (MHD) forces generated by passing a D.C. current through a molten metal while simultaneously subjecting the molten metal to a magnetic field oriented at an angle perpendicular to the electric current. In summary, the present invention involves a method and apparatus for providing a fine-particle, molten metal spray comprising:

(1) providing a molten metal;

(2) passing an electric current through the molten metal to produce a current carrying volume therein; and (3) simultaneously applying a magnetic field in a plane perpendicular to the electric current, so as to produce an acceleration of the current carrying volume of molten metal, thereby causing a breakup of the molten metal into fine particulate droplets.

Figure 1:
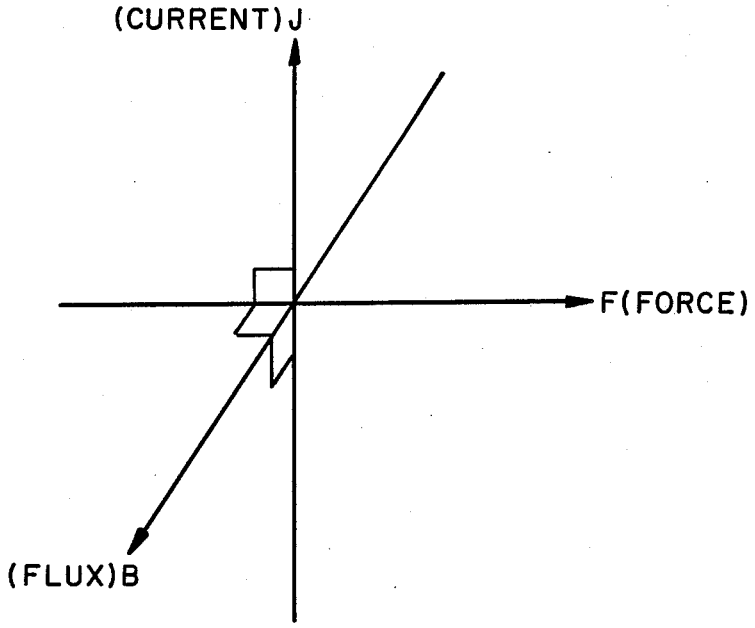
FIG. 1 is a diagram showing the relationship between the direct electrical current, the magnetic flux and the directional force propelling the molten metal particles.

The present invention uses magnetohydrodynamic (MHD) forces generated by passing a D.C. current perpendicularly through a magnetic field. A molten metal is provided within the magnetohydrodynamic forces, which causes the molten metal to be atomized. The resulting molten metal droplets are propelled by the MHD forces in a direction perpendicular to both the electric current and magnetic field and onto a suitable substrate. FIG. 1 shows the relationship between electric current (J), the magnetic lines of flux (B) and the direction of force (F) in which the molten metal is propelled.

The basic mechanism involved in operation of this invention is believed to be as follows. A magnetic field will impose a force (the Lorentz force) upon the electrons moving in a conductor within that field. This force, seen as a body force applied to the conductor, is always at right angles to the plane containing the magnetic flux direction and the direction of flow of electric current. The magnitude of the force is:

$$\vec{F}(N/m^3)=\vec{B}(Wb/m^2)\times\vec{J}(A/m^2)$$

where:

$\vec{F}$=force, in Newtons per cubic meter of conductor,
$\vec{B}$=magnetic flux, in Webers per square meter, and
$\vec{J}$=current, in amperes per square meter.

The molten metal can be provided as a stream of molten metal within the MHD forces or the molten metal can be provided from a wire fed to an arc melting zone within the MHD forces. The MHD forces can be obtained by passing an electric current through the molten metal and at the same time placing the molten metal between the faces of a magnet. The electric current can be used at 20–100 Amp., although other amounts of electric current can be used when desirable. The magnet can produce a flux at a right angle to the flow of electric current of about 1 tesla (10 kG), although other amounts of flux can be used when appropriate. It is also possible to use A.C. currents in the magnet and the molten metal if proper attention is given to the phase relationships.

When utilizing a flow of molten metal, the molten metal is passed through a nozzle in such a way that the molten metal contacts two electrodes. This introduces an electrical current across the molten metal stream at the nozzle. At the same time that the molten metal flows through the nozzle, the nozzle is situated between the poles of a magnet. This introduces a magnetic field at an angle 900° to the electric current. This combination of electric current and perpendicularly arranged magnetic field produces a force on the current-carrying volume of liquid metal.

Figure 2A:
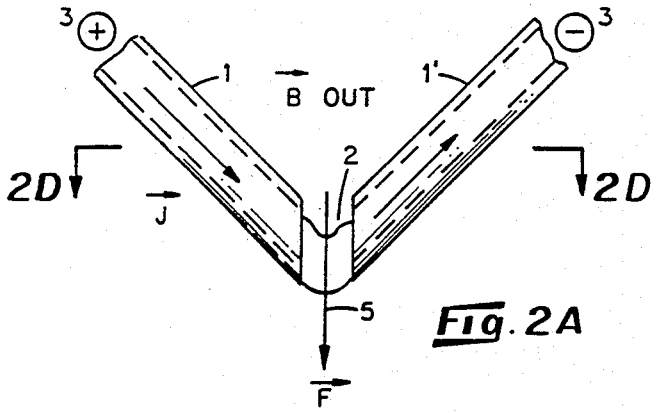
FIGS. 2A, 2B, 2C and 2D are schematic drawings of a nozzle used the present invention and an operation of the present invention.
Figure 2B:
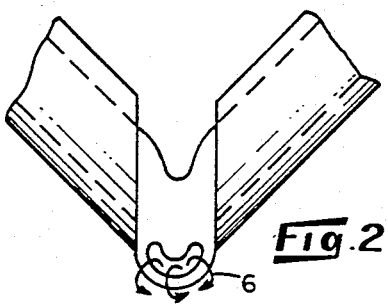
Figure 2C:
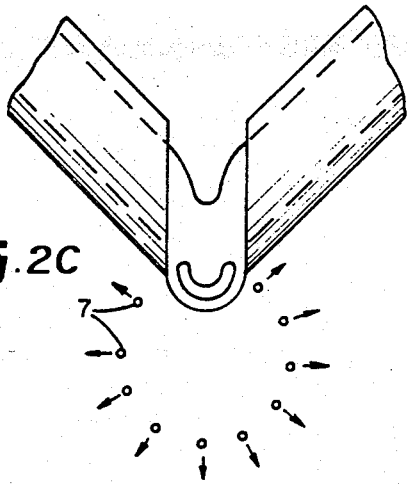
Figure 2D:
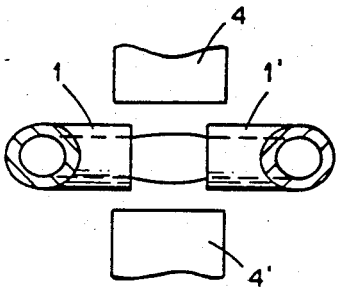

An apparatus illustrating the method of the present invention is shown in FIG. 2A. In this method and apparatus, a molten metal stream flows through a nozzle. In the device shown in FIG. 2A, a nozzle comprises two feed tubes 1, 1' made of, for example, copper with slanted end openings. The two feed tubes 1, 1' are arranged with their slanted end openings facing one another so that a gap 2 is formed therebetween. Generally, the molten metal flows from both tubes into the gap 2. A D.C. current 3 is passed through at least a portion of the tubes 1, 1' in a manner that results in the D.C. current being passed through the molten metal at gap 2. Gap 2 is placed between the pole faces of magnet, so that magnetic flux interacts with the electric current in the molten metal at gap 2. In the arrangement as shown in FIG. 2A, one magnetic pole 4, is placed in front of gap 2 and the other magnetic pole 4', is placed behind gap 2, as shown in FIG. 2D and in a manner such that the magnetic flux resulting therefrom is perpendicular to the direction of the electric current. This crossing of electric current and magnetic flux results in a rapid acceleration force 5 on the molten metal exposed in gap 2. The leading edge of the molten metal slug apparently accelerates at a rate that causes molten metal filaments 6 to break away from the rest of the slug, as shown in FIG. 2B.

The D.C. current flowing through a filament induces magnetic flux lines around the filament (right hand rule) and stabilizes it as it forms a circular arc. At this point each filament is accelerating radially. As shown in FIG. 2C, the filaments eventually break, and the resulting molten metal droplets 7 are thrown radially away in a plane centered in and parallel to the magnet faces. A cooled substrate (not shown) is placed perpendicular to this plane for collection of the molten metal droplets and/or for coating of the substrate. Each filament breakage is accompanied by an arc. Judging by the frequency of the arcing, the filament formation appears to be virtually continuous.

Figure 3:
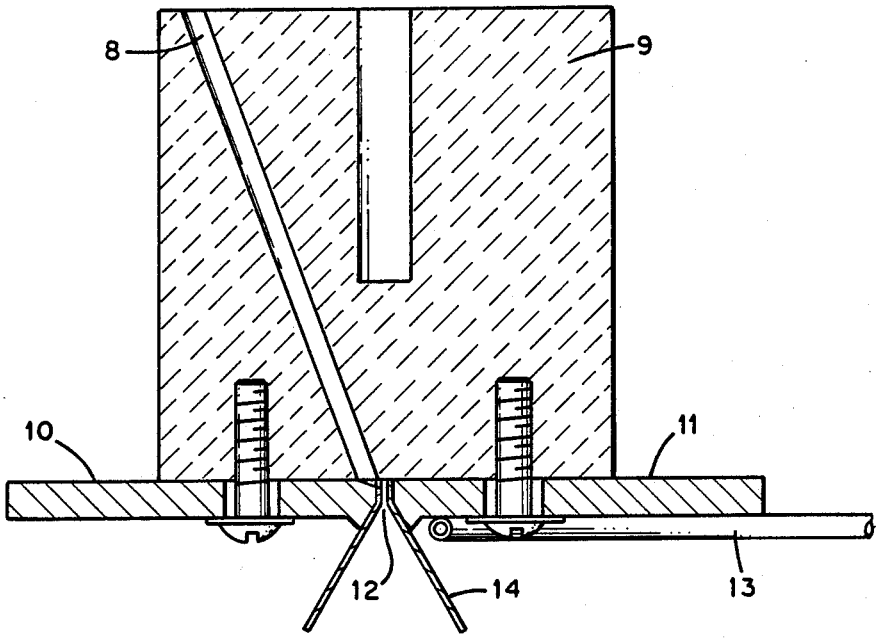
FIG. 3 is a schematic drawing of another atomizing nozzle in accordance with this invention.

Several different possibilities exist for the location of the electrodes and the metal feed. FIG. 3 illustrates a second nozzle configuration that has been used with good success. A feed tube 8 penetrates a ceramic block 9 and empties into a small tapered chamber machined into one copper electrode (cathode) 10. This electrode is spaced a particular distance from the second electrode (anode) 11 so as to form a gap 12 of the desired size. Electrode 11 is water cooled 13 because of the electron bombardment due to the current flow. The entire atomizer device is placed between the poles of a D.C. electromagnetic as before. In operation, molten metal is introduced into the feed tube 8 and runs into the tapered chamber in the cathode 10 and thence into the gap 12, where it completes the electrical circuit and is accelerated down between copper wings 14 which stabilize the filaments until they disentegrate. As described previously, the combination and crossing of the flowing D.C. current with the magnetic field accelerates the molten metal out of the gap.

Figure 4:
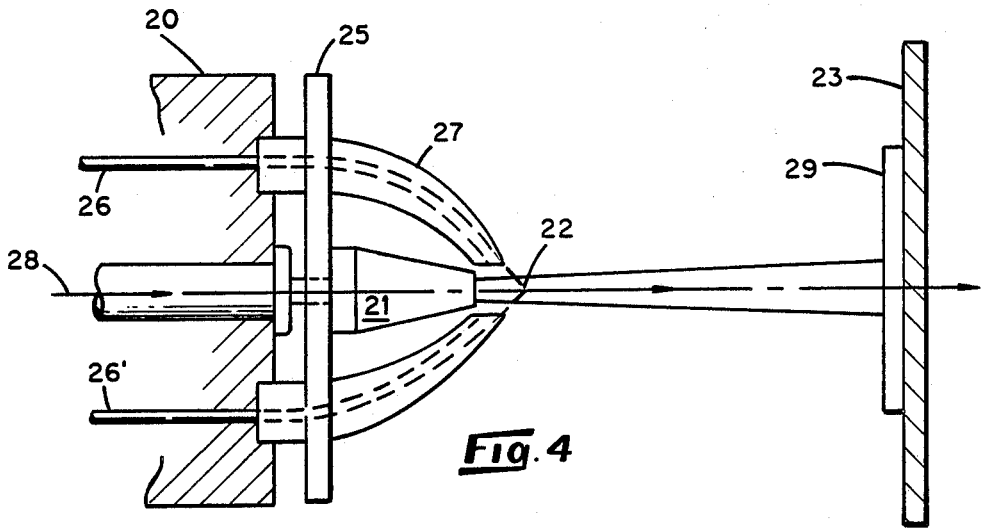
FIG. 4 shows a conventional electric gas arc-spray device.

The present invention can also utilize a thermal spraying mechanism. A conventional electric-arc spray device is shown in FIG. 4, including an insulated housing 20, wire guides 27, etc. In this arrangement, wires 26, 26' are fed to the arc point 22 where the molten metal is stripped by high pressure air from nozzle 21. High pressure gas is fed to nozzle 21 from feed 28. The molten metal deposits on substrate 23 to form layer of sprayed material 29. The sprayed molten metal can be stripped from the substrate and worked using conventional metal working procedures. It is assumed that the wire feed is controlled by a servomechanism (30, 30' in FIG. 5) operated by a potential drop across the arc or by some other method familiar to those skilled in the art.

Figure 5:
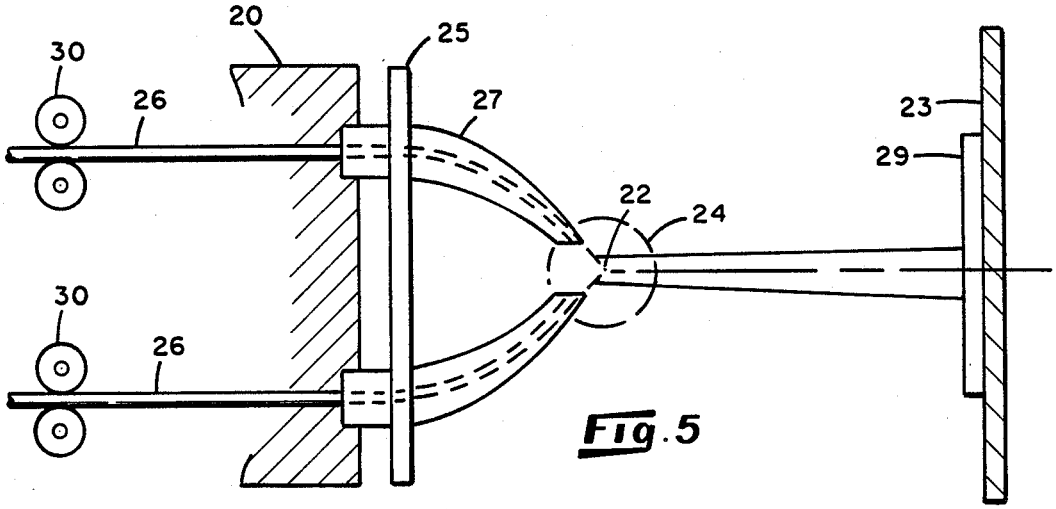
FIG. 5 shows a magnetohydrodynamic-electric arc-spray device according to the present invention.

An important feature of the present invention is the use of a means for propelling molten metal particles toward a substrate for deposition thereon, without the need for using compressed gas for atomization, as in the prior art. This is illustrated in FIG. 5, which uses the same legends as used in FIG. 4, as well as the same basic structure and assumptions about the wire feed mechanism. In FIG. 5, wires 26, 26' are fed to the arc point 22 which is positioned between the pole faces of a magnet. FIG. 5 shows one pole face 24 of a magnet located behind arc point 22. The other face of the magnet is located in front of arc point 22 opposite pole face 24. The D.C. current flows unidirectionally into the arc gap 22 through one wire 26 and out through the other wire 26'. The arc is formed between the faces of either a D.C. electromagnet or a permanent magnet 24 so that the electric current (J) and the magnetic flux (B) lines cross at a right angle and the molten metal is propelled in the direction of the force (F), as shown in FIG. 1.

Depending upon the properties desired in the deposit, the particles can impact the substrate either fully liquified or partially solidified. Their physical state can be controlled by length of fight path, by the presence of an inert cooling gas, or by varying the intensity of the arc. The choice of amount of particle solidification in flight will depend on the material being deposited and the required structure in the deposit itself.

As shown in FIGS. 2A, 3 and 5, a variety of apparatus and nozzle designs can be used to produce the MHD accelerating forces and the metal powder production resulting therefrom, in accordance with the present invention. When higher melting point metals and alloys are used as feed material in the devices shown in FIGS. 2A and 3, the nozzle materials can be changed to ceramic and/or water-cooled copper. In the case of an all-ceramic nozzle, the molten metal itself can be used to conduct current to the accelerating gap or else a conducting ceramic such as $TiB_2$ can be used as the electrodes.

EXAMPLES 1-5 COMPARED TO COMMERCIAL ATOMIZERS

Several examples using low-melting alloys were carried out using the nozzle design shown in FIG. 3. In the examples 1-5, Runs 17, 20, 21, 25, and 26, a bismuth-lead-tin alloy (50 wt% Bi, 30 wt% Pb, 20 wt% Sn) was used, which had a melting point of approximately 100° C. These examples are compared to two commercial atomizing processes in FIG. 6. The Ar-atomized powder was produced by the compressed gas process discussed earlier and the rotating-electrode-atomized powder was produced by an arc impinging upon and melting the end of a rotating rod of feed stock. The rotation produced a radial spray of molten droplets that solidified into powder. It is evident that the powder sizes produced by the subject MHD atomizer are approaching the commercial powder sizes. Further refinement of the device should lead to comparable size ranges.

The paramters and results for Examples 1-5 are given in Table 1, below.

TABLE 1

| | Run # | | | | |
|---|---|---|---|---|---|
| | 17 | 20 | 21 | 25 | 26 |
| Magnetic flux (kG) | 1.6 | 1.6 | 1.6 | 1.6 | 1.6 |
| Current (A) | 60 | 40 | 50 | 60 | 60 |
| Electrode gap (mm) | 0.5 | 0.5 | 0.38 | 0.5 | 0.5 |
| Particle flight length (m) | 1 | 4 | 4 | 1 | 4 |
| Powder Size Distribution (%) | | | | | |
| Standard Mesh Sizes (m) | | | | | |
| −1240 +840 | 10.50 | 4.20 | 3.83 | 15.98 | 3.09 |
| −840 +590 | 16.14 | 11.72 | 10.36 | 22.12 | 7.55 |
| −590 +420 | 13.71 | 19.68 | 17.13 | 16.74 | 14.75 |
| −420 +297 | 12.70 | 23.93 | 23.84 | 14.73 | 25.14 |
| −297 +250 | 4.94 | 8.04 | 8.32 | 5.04 | 8.88 |
| −250 +210 | 6.21 | 8.16 | 8.42 | 5.03 | 9.04 |
| −210 +177 | 7.92 | 7.25 | 7.38 | 4.38 | 8.16 |
| −177 +150 | 5.01 | 4.41 | 4.84 | 2.82 | 5.13 |
| −150 +125 | 5.67 | 4.03 | 4.55 | 3.05 | 4.84 |
| −125 +106 | 4.57 | 2.71 | 3.23 | 2.27 | 3.49 |
| −106 +90 | 3.98 | 2.02 | 2.54 | 1.97 | 2.90 |
| −90 +75 | 2.69 | 1.27 | 1.70 | 1.56 | 2.04 |
| −75 +63 | 2.25 | 0.86 | 1.20 | 1.28 | 1.45 |
| −63 +53 | 1.29 | 0.62 | 0.85 | 0.91 | 1.05 |
| −53 +45 | 0.98 | 0.46 | 0.71 | 0.67 | 0.88 |
| −45 | 1.43 | 0.64 | 1.10 | 1.45 | 1.60 |

Figure 6:
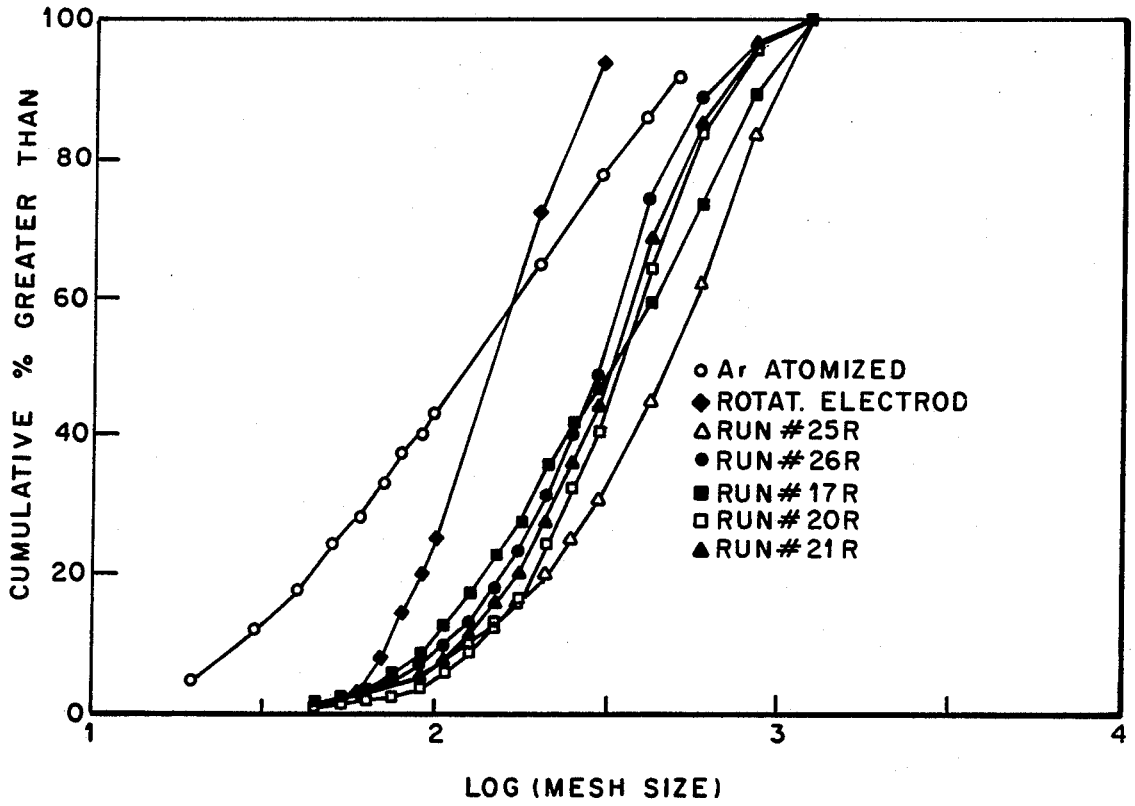
FIG. 6 shows the particle size distribution of metal particles obtained according to the present invention.

The particle size distribution of the metal particles formed in Example 1-5 is shown in FIG. 6.

Figure 7:
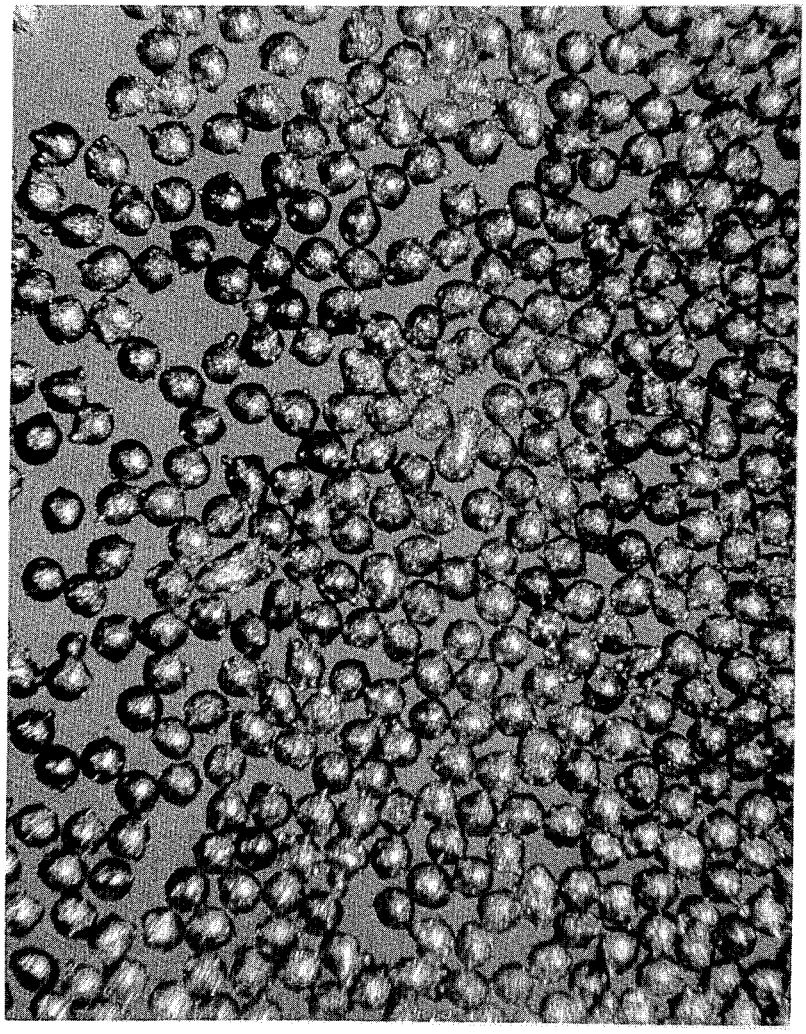
FIG. 7 shows $Ni_3Al$ powder produced by a conventional gas atomization process.
Figure 8:
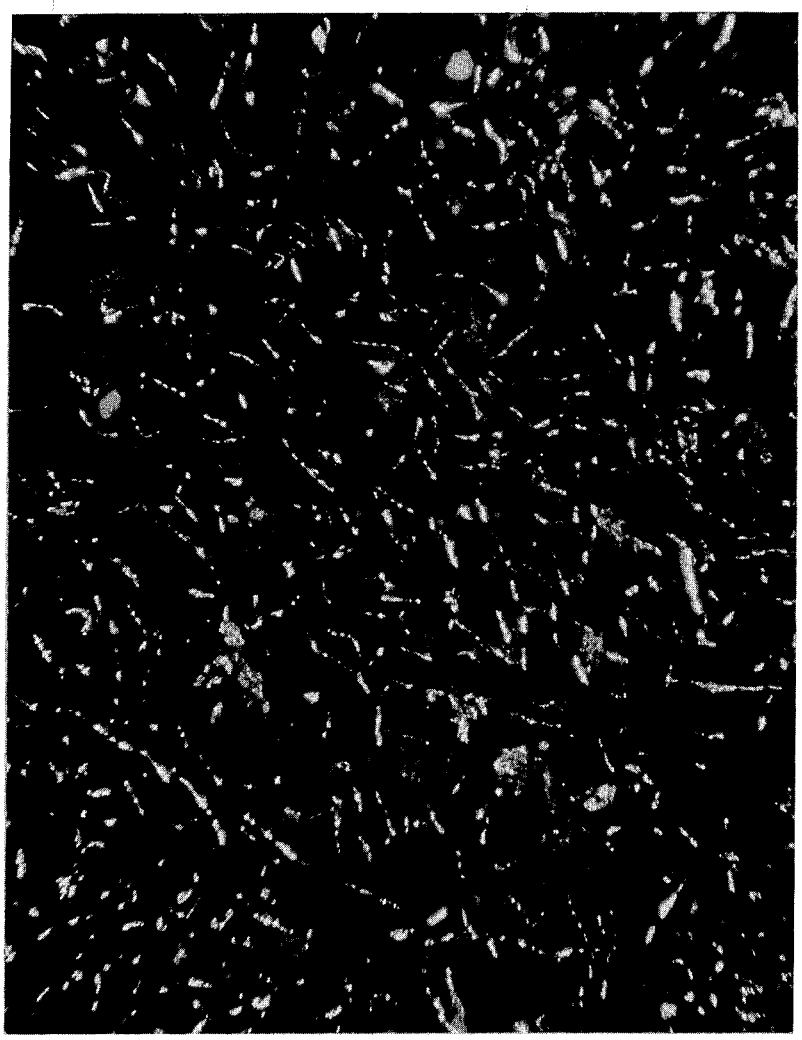
FIG. 8 shows metal particles produced by the present invention.

An advantage of the present invention is shown in FIGS. 7 and 8, and involves particle shapes. FIG. 7 shows $Ni_3Al$ powder produced by a conventional gas atomization process. As shown in FIG. 8, the conventional gas atomization process results in generally spherical particles. Spherical particles are one of the least optimum shapes for subsequent powder metallurgy processing. In contrast to FIG. 7, FIG. 8 shows the metal alloy (i.e., low-melting point alloy) after atomization in accordance with the present invention. It is particularly noteworthy that the resulting particles have various shapes but lack a spherical shape. The powders shown in FIGS. 7 and 8 were passed through a 100 mesh (U.S. sieve size) screen (149 um hole size). The irregular shaped particles obtained by the present invention are much more amenable to further processing.

The present invention has broad applications in the atomization and deposition of molten metals. It does not require large amounts of high pressure gas. In fact the present invention can be operated in a vacuum. The present invention also does not require high voltages and can be operated with modest power requirements of, for example, 2 kW d.c., although higher amounts can also be used, when appropriate. Due to the modest power requirements and the lack of a need for high pressure gas, the present invention can be operated economically. In the event that room-temperature superconductors become a commercial reality, the much stronger B fields supplied by superconducting magnets would decrease the J current requirements and, therefore, the arcing in the present process. This would simplify electrode design.

Since the present invention can be operated in a vacuum, it is possible to atomize reactive metals and alloys without contamination by a gas and without absorbtion or entrapment of gasses. The present invention can be used with any type of metal or metal alloy, which can be made molten, such as Al and Fe. It is also possible to atomize toxic materials, such as Be and Se, and pyrophoric materials, such as Zr and Ti.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method for producing a directed spray of fine particulate molten metal comprising:
   - providing spaced apart electrodes defining an open-ended zone therebetween for receiving molten metal feed;
   - providing a flow of molten metal feed into said zone in contact with said electrodes, thereby creating a flow path for electric current between said electrodes;
   - providing a magnetic field through said zone in a direction perpendicular to said flow path for electric current through said zone; and
   - passing an electric current through said electrodes and said molten metal in said zone to create magnethydrodynamic forces which accelerate said molten metal within said zone in a direction perpendicular to said flow path and said magnetic field thereby causing said molten metal feed to exit said zone and disperse into fine particulate droplets; the directions of said magnetic field and electric current being selected to provide the desired direction of acceleration of said molten metal feed.

2. The method as set forth in claim 1 wherein the nozzle includes two, spaced apart, feed tubes for carrying molten metal feed therethrough to said zone and the electric current is passed through said tubes.

3. The method as set forth in claim 2 wherein the two feed tubes have open ends arranged to face each other with said open ended zone being defined by a spacing therebetween and said molten metal feed flows from said feed tubes into said spacing wherein the respective flows contact each other.

4. The method of claim 1 wherein the molten metal feed is provided by advancing solid metal wires into said zone while maintaining an electric arc between said wires to change the solid wires to a molten state.

5. An apparatus for producing a directed spray of fine particulate molten metal comprising;

spaced apart electrode defining an open-ended zone therebetween for receiving molten metal feed;

means for providing a flow of molten metal feed into said zone means including said electrodes, for passing an electric current through said molten metal in said zone;

and means for providing a magnetic field through said zone in a direction perpendicular to the flow of electric current through said zone to create magnethydrodynamic forces which accelerate said molten metal feed within said zone in a direction perpendicular to the flow of electric current and said magnetic field, thereby causing said molten metal feed to exit said zone and disperse into fine particulate droplets, the directions of said magnetic field and electric current being selected to provide the desired direction of acceleration of said molten metal feed.

6. The apparatus of claim 5 wherein said nozzle includes two, spaced apart feed tubes for carrying molten metal feed therethrough to said zone, and wherein electric current is passed through said tubes.

7. The apparatus of claim 5 wherein the means for providing a flow of molten metal into said zone includes solid metal wires and means for advancing said solid metal wires into said zone while maintaining an electric arc between said wires to change the solid wires to a molten state.

* * * * *